United States Patent [19]

Herchner

[11] 3,979,663

[45] Sept. 7, 1976

[54] CONSTANT CURRENT SOURCE

[75] Inventor: Dieter Herchner, Heilbronn, Germany

[73] Assignee: Licentia Patent-Verwaltungs-G.m.b.H., Frankfurt am Main, Germany

[22] Filed: Jan. 29, 1975

[21] Appl. No.: 545,294

[30] Foreign Application Priority Data

Feb. 23, 1974 Germany ..... 2408755

[52] U.S. Cl. ..... 323/4

[51] Int. Cl.[2] ..... G05F 1/56

[58] Field of Search ..... 323/1, 4, 8

[56] References Cited

UNITED STATES PATENTS 3,375,434 3/1968 Shapiro ..... 323/4

*Primary Examiner*—A. D. Pellinen

*Attorney, Agent, or Firm*—Spencer & Kaye

[57] ABSTRACT

A constant current source comprises first and second complementary transistors with their emitter being connected to different poles of a direct voltage source $U_B$ by emitter resistors $R_1$ and $R_2=nR_1$ respectively, with the collector of the first transistor being connected to one pole of the source $U_B$ via a load resistor, and with the collector of the second transistor being connected to the emitter of the first transistor; and a third transistor through which part of the current from the first or second transistors is taken and has its collector connected to one of the current electrodes of said first and second transistors and its emitter connected by an emitter resistance $R_3 = mR_1$ to one pole of the direct voltage supply voltages are applied to the respective bases of the transitors in accordance with the equations:

$$U_1 = K_1 U_B$$

$$U_2 = U_B - K_2 U_B$$

$$U_3 = bU_{R1}$$

where $U_{R1}$ is the voltage drop across $R_1$ and $K_1$, $K_2$, $b$, $n$, and $m$ are constants in which:

$$K_2 = nK_1$$

$$1/n = 1+1/b$$

$$m = b$$

7 Claims, 3 Drawing Figures

CONSTANT CURRENT SOURCE

BACKGROUND OF THE INVENTION

This invention relates to a constant current source with a current independent of the supply voltage and temperature.

Direct current sources, which have a high internal resistance compared to their ballast resistance and are as stable as possible, are required for the operation of transistor circuits. An important requirement of this direct current source consists in the fact that the current should be independent of the supply voltage in order to avoid any operating point displacement of the circuit in this way.

SUMMARY OF THE INVENTION

It is an object of the invention to provide a circuit arrangement which produces an output which is independent of the supply direct voltage and temperature.

According to a first aspect of the invention, there is provided a constant current source comprising a direct voltage supply, a first transistor, a first emitter resistance connected between the emitter of the said first transistor and a first pole of said direct voltage supply, a load resistance connected between the collector of the first transistor and the second pole of said direct voltage supply a second transistor complementary to said first transistor, a second emitter resistance connected between the emitter of said second transistor and a said second pole of said direct voltage supply, means connecting the collector of said second transistor with the emitter of said first transistor, a third transistor through which part of the current from one of said first and second transistors is removed, a third emitter resistance connected between the emitter of said third transistor and one of said poles of said direct voltage supply with the circuit having the following characteristics:

$$R_2 = nR_1$$

$$R_3 = mR_1$$

$$U_1 = K_1U_B$$

$$U_2 = U_B - K_2U_B$$

$$U_3 = bU_{R1}$$

wherein $R_1$ is the value of said first emitter resistance
$R_2$ is the value of said second emitter resistance
$R_3$ is the value of said third emitter resistance
$U_1$ is the voltage applied to the base of said first transistor
$U_2$ is the voltage applied to the base of said second transistor
$U_3$ is the voltage applied to the base of said third transistor
$U_B$ is the voltage of the direct voltage supply
$U_{R1}$ is the voltage drop across $R_1$
and $K_1$, $K_2$, $n$, $m$, and $b$ are constants in which:

$$K_2 = nK_1$$

$$1/n = 1+1/b$$

$$m = b$$

According to a second aspect of the invention, there is provided a constant current source with an output current independent of the supply voltage and the temperature, comprising first and second complementary transistors the emitter of said first transistor being connected via an emitter resistance $R_1$ across which, in operation, a voltage $U_{R1}$ drops, to one pole of a direct voltage supply $U_B$, and the emitter of said second transistor being connected via an emitter resistance $R_2 = nR_1$ to the other pole of said direct voltage supply $U_B$, the collector of said first transistor being connected via the load resistance for the current to said other pole of said direct voltage supply the collector of said second transistor being connected to the emitter of said first transistor, a further transistor $T_3$ through which a part of the current is removed from one of said first and second transistors, and whose collector is connected to one of the electrodes of said first and second transistors and whose emitter is connected via an emitter resistance $R_3 = mR_1$ to a terminal of said direct voltage supply; and wherein the following direct voltages with assigned indices:

$$U_1 = K_1U_B,\ U_2 = U_B - K_2U_B,\ U_3 = bU_{R1},$$

are applied in operation to the bases of said first, second and further transistors and the circuit is so dimensioned to achieve a voltage and temperature-independent collector current I* through said load resistance of said first transistor such that the following interrelationships between the constants $K_1$, $K_2$, $n$, $m$, $b$ apply:

$$K_2 = nK_1,\ 1/n = 1+1/b,\ m = b.$$

DESCRIPTION OF THE PREFERRED EMBODIMENT

Basically, the invention proposes that the circuit has two complementary transistors $T_1$, $T_2$, wherein the emitter of the first transistor $T_1$ is connected via an emitter resistance $R_1$, across which the voltage $U_{R1}$ drops in operation, to one pole of the direct supply voltage $U_B$ and the emitter of the second transistor $T_2$ is connected via an emitter resistance $R_2 = n \cdot R_1$ to the other pole of the direct voltage supply $U_B$, that the collector of the second transistor $T_2$ is connected to the emitter of the first transistor $T_1$, that a further transistor $T_3$ is provided by which a part of the current is removed from one of the two other transistors, $T_1$ and $T_2$ wherein this third transistor $T_3$ is connected via an emitter resistance $R_3 = mR_1$ to a pole of the direct voltage supply $U_B$, that there are applied to the three base electrodes of the transistors present, in operation, the following direct voltage with assigned indices:

$$U_1 = K_1U_B,\ U_2 = U_B - K_2U_B,\ U_3 = bU_{R1}$$

and that to achieve a voltage and temperature independent collector current I* of the transistor $T_1$, the circuit is so dimensioned that the following relationships between the constants $K_1$, $K_2$, $n$, $m$, $b$ apply:

$$K_2 = nK_1,\ 1/n = 1+1/b,\ m = b.$$

Figure 3:
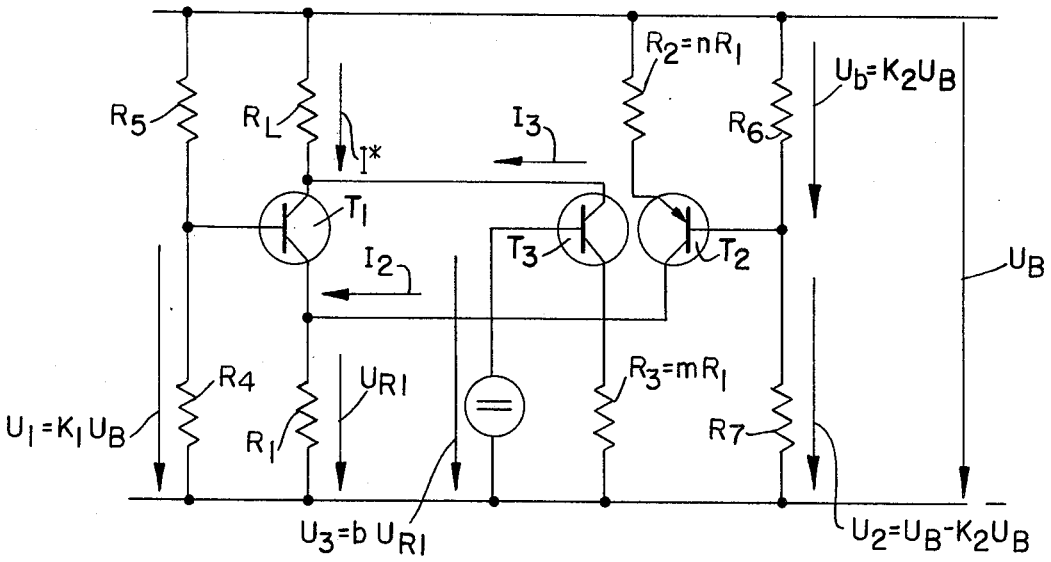
FIG. 3 is a circuit diagram showing another modification of the embodiment of FIG. 1.

The collector of the additional transistor $T_3$ can be connected to different places of the two other transistors $T_1$, $T_2$. Preferably the collector of the transistor $T_3$ is connected either to the collector electrode or to an emitter electrode (FIG. 1) of transistor $T_2$. However, the collector of transistor $T_3$ can even be connected to the collector electrode of transistor $T_1$ (FIG. 3). The transistors $T_1$ and $T_3$ have the same sequence of regions i.e., they are the same polarity type (*npn* in the illustrated circuit).

The circuit has the two complementary transistors $T_1$ and $T_2$, both of which are driven in the emitter circuit. The transistor $T_1$ is, for example, a *npn* transistor; then the transistor $T_2$ is a *pnp* transistor. The collector of the transistor $T_2$ is connected to the emitter electrode of the transistor $T_1$. Both electrodes are connected via the common resistance $R_1$ to the negative terminal of the direct voltage supply $U_B$. The emitter electrode of the transistor $T_2$ is connected via the resistance $R_2 = n \cdot R_1$ to the positive terminal of the supply voltage source. The collector connection of the transistor $T_1$ is connected to the same terminal of the supply voltage source via the ballast or load resistance $R_L$. The constant current I* should flow through the ballast resistance $R_L$ and produce a voltage across it corresponding to the current I* and is thus likewise predetermined. The voltage $U_1 = K_1 \cdot U_B$ lies between the base electrode of the transistor $T_1$ and the negative pole of the supply voltage source. The factor $K_1$ thus determines the voltage part of the supply voltage $U_B$ applied to the base electrode of $T_1$. The voltage $U_1$ is obtained, for example, with the help of a base voltage divider comprising resistances $R_4$ and $R_5$.

Figure 2:
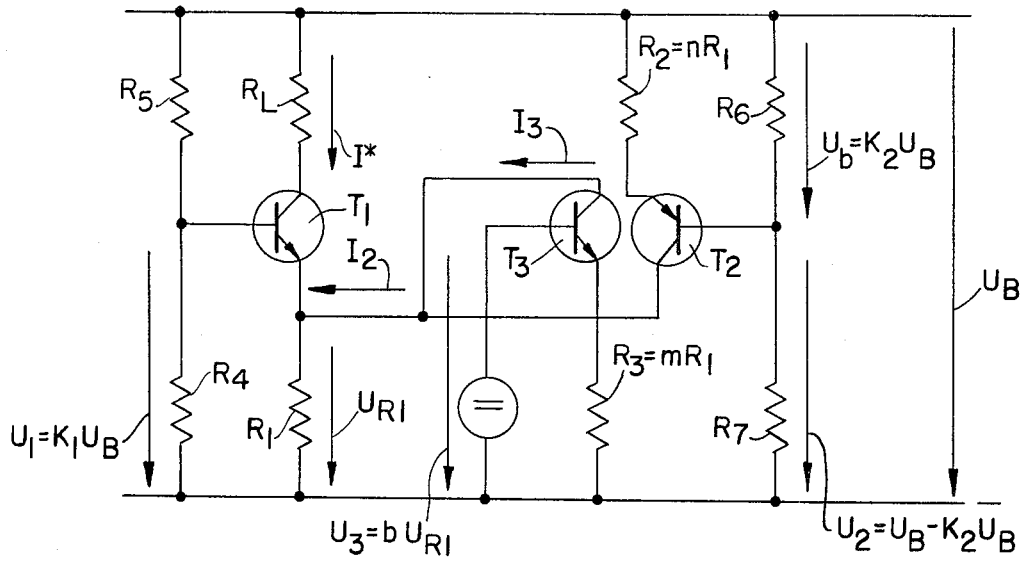
FIG. 2 is a circuit diagram showing a modification of the embodiment of FIG. 1.

In a corresponding manner the voltage $U_2 = U_B - K_2 \cdot U_B$ lies between the base electrode (FIG. 2) of the transistor $T_2$ and the negative terminal of the supply voltage source. The factor $K_2$ thus determines the part of the supply voltage applied between the base electrode of $T_2$ and the positive terminal of the supply voltage. This voltage $U_2$ can also be realized, for example, with the help of a base voltage divider comprising resistances $R_6$ and $R_7$.

Figure 1:
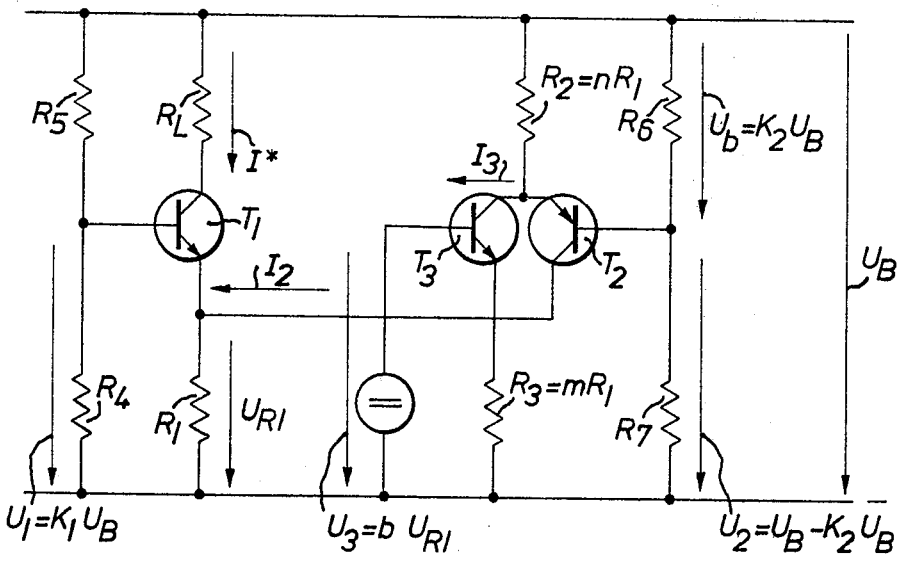
FIG. 1 is a circuit diagram of a constant current source in accordance with the invention.

The npn transistor $T_3$ is connected via the emitter resistance $R_3 = mR_1$ to the negative terminal of the supply voltage, while the collector of $T_3$ is connected, for example, as shown in FIG. 1 to the emitter of transistor $T_2$. At the base electrode of transistor $T_3$ is applied the voltage $U_3 = bU_{R1}$, when $U_{R1}$ is the voltage across the resistance $R_1$. A current, current $I_3$, by which temperature conditioned variations of the current $I_2$ are compensated for, is taken off through the transistor $T_3$ from the transistor $T_2$, which supplies at the emitter path of the transistor $T_1$ a current of the value $I_2$.

In the case of the circuit described, for the constant current I* flowing through the ballast resistance $R_L$ the following applies:

$$T^* = \frac{K_1 \cdot U_B}{R_1} - \frac{U_{BE}}{R_1} - \frac{K_2 \cdot U_B}{n \cdot R_1} + \frac{U_{BE}}{nR_1} + \frac{U_3}{m \cdot R_1} - \frac{U_{BE}}{m \cdot R_1}$$

From the condition that the current I* should be independent of the supply direct voltage, there results the specification:

$$K_2 = nK_1$$

From the further condition that the current I* should also be temperature independent, the following specifications result:

$$1/n = 1+1/b$$

$$m = b$$

If the specifications are maintained in the dimensioning of the circuit, a constant current I* through the ballast resistance $R_L$ is obtained over and above temperature and the direct voltage of the supply.

For example it is specified that the current should be $T^* = 1\,mA$ large. If the values for $k_1 = ½$, $b = 1$, and $R_1 =$ 1kOhm are assumed, there results from the above-listed equations:

$$n = 0.5;\ m = b = 1,\ \text{and}\ K_2 = 0.25$$

The resistance $R_3$ must thus be the same size as $R_1$, whereas the resistance $R_2$ is only half as large as $R_1$. At the base of $T_1$ is applied half the supply voltage, at the base of $T_2$ is applied 75% of the supply voltage. The voltage $U_3 = bU_{R1} = b \cdot I \cdot R_1 = 1 \times 1mA \times 1k\text{Ohm} = 1$ volt is applied to the base of $T_3$. The supply voltage $U_B$ amounts, for example, to 10 volts. In tests it has been shown that the current I* remains absolutely constant even over a temperature range of 150°C.

What is claimed is:

1. A constant current source with a current independent of the supply voltage and the temperature, comprising: first and second complementary transistors with the emitter of said first transistor being connected via an emitter resistance $R_1$, across which, in operation, a voltage $U_{R1}$ drops, to one pole of a direct voltage supply $U_B$, the emitter of said second transistor being connected via an emitter resistance $R_2 = nR_1$ to the other pole of said direct voltage supply $U_B$, the collector of said first transistor being connected via a load resistance $R_L$ to said other pole for said direct voltage supply $U_B$, and the collector of said second transistor being connected to the emitter of said first transistor; a further transistor $T_3$ through which a part of the current is removed from one of said first and second transistors, the emitter of said further transistion being connected via an emitter resistance $R_3 = mR_1$ to a terminal of said direct voltage supply, and the collector of said further transistor being connected to one of the emitters and collectors of said first and second transistors; and means for applying in operation the following direct voltages with assigned indices $$U_1 = K_1U_B,\ U_2 = U_B - K_2U_B,\ U_3 = bU_{R1},$$

to the bases of said first, said second and said further transistors respectively; and wherein the circuit is so dimensioned that the following interrelationships between the constants $k_1$, $k_2$, $n$, $m$, $b$ apply:

$$K_2 = nK_1,\ 1/n = 1+1/b,\ m=b,$$

whereby a voltage and temperature independent collector current I* for said first transistor is achieved.

2. A constant current source as defined in claim 1, wherein said collector of said further transistor is connected to the emitter electrode of said second transistor.

3. A constant current source as defined in claim 1, wherein said first and further transistors comprise transistors with the same region sequence.

4. A constant current source as defined in claim 1, wherein: said first and further transistors are npn transistors, the emitter electrodes of which are connected via the associated emitter resistance to the negative terminal of said direct voltage supply, while said second transistor is a pnp transistor, the emitter electrode of which is connected via its emitter resistance to the positive terminal of said direct voltage supply.

5. A constant current source as defined in claim 1 wherein said collector of said further transistor is connected to the collector electrode of said second transistor.

6. A constant current source as defined in claim 1 wherein said collector of said further transistor is connected to the collector electrode of said first transistor.

7. A constant current source circuit comprising: a direct voltage supply; a first transistor; a first emitter resistance connected between the emitter electrode of said first transistor and a first pole of said direct voltage supply; a load resistance connected between the collector electrode of said first transistor and the second pole of said direct voltage supply; a second transistor complementary to said first transistor; a second emitter resistance connected between the emitter electrode of said second transistor and said second pole of said direct voltage supply; means connecting the collector of said second transistor with the emitter of said first transistor; a third transistor, of the same polarity type as said first transistor, through which part of the current from one of said first and second transistors is removed, said third transistor having its collector electrode connected to one of the emitter and collector electrodes of said first and second transistors; a third emitter resistance connected between the emitter electrode of said third transistor and said first pole of said direct voltage supply; and means for applying respective voltages to the bases of said first, second, and third transistors; and wherein said circuit and said voltages applied to the bases of said transistor have the following characteristics:

$$R_2 = nR_1,\ R_3 = mR_1$$

$$U_1 = K_1 U_B$$

$$U_2 = U_B - K_2 U_B$$

$$U_3 = bU_{R1}$$

wherein of said further transistor being $R_1$ is the value of said first emitter resistance $R_2$ is the value of said second emitter resistance $R_3$ is the value of said third emitter resistance $U_1$ is the voltage applied to the base of said first transistor $U_2$ is the voltage applied to the base of said second transistor $U_3$ is the voltage applied to the base of said third transistor $U_B$ is the voltage of the direct voltage supply $U_{R1}$ is the voltage drop across $R_1$ and $K_1$, $K_2$, $n$, $m$, and $b$ are constants in which $$K_2 = nK_1$$

$$1/n = 1 + 1/b$$

$$m = b.$$

* * * * *